United States Patent [19]

Diaz

[11] Patent Number: 4,665,634

[45] Date of Patent: May 19, 1987

[54] CHILD'S BOOTLET WITH SEPARABLE FRONT AND REAR PORTIONS

[76] Inventor: Alberto O. Diaz, 11922 Morrie La., Garden Grove, Calif. 92640

[21] Appl. No.: 791,531

[22] Filed: Oct. 25, 1985

[51] Int. Cl.[4] ..... A43B 3/30; A43B 11/00

[52] U.S. Cl. ..... 36/112; 36/50

[58] Field of Search ..... 36/105, 112, 50, 44

[56] References Cited

U.S. PATENT DOCUMENTS

| | | | |
|---|---|---|---|
| 1,648,101 | 11/1927 | Ascheim | 36/50 |
| 2,494,770 | 1/1950 | MacLaughlin | 36/112 |
| 2,502,774 | 4/1950 | Alianiello | 36/44 X |
| 3,349,505 | 10/1967 | Lopez | 36/112 |
| 3,396,480 | 8/1968 | Sherman | 36/112 |

FOREIGN PATENT DOCUMENTS

| | | | |
|---|---|---|---|
| 3310988 | 9/1984 | Fed. Rep. of Germany | 36/112 |

*Primary Examiner*—James Kee Chi

*Attorney, Agent, or Firm*—Plante, Strauss & Vanderburgh

[57] ABSTRACT

There is disclosed footwear, such as a bootlet, for children in which the entire bootlet, rearwardly of the instep is separable from the forward portion, with a continuous strip fastener that extends vertically along the sides and beneath the arch to removably join the front and rear portions. Preferably, the two portions are permanently secured together on one side, at their top edges with a welting which extends about the top edges of the bootlet. The forward portion of the sole of the bootlet has foam padding on its outside surface and this is covered with an outer sole, thereby providing a very soft cushion beneath the ball of the child's foot.

10 Claims, 5 Drawing Figures

CHILD'S BOOTLET WITH SEPARABLE FRONT AND REAR PORTIONS

BACKGROUND OF THE INVENTION

1. Field of the Invention

This invention relates to footwear and, in particular, to a bootlet for children.

2. Brief statement Of The Prior Art

Shoes and bootlets for infants and very young children have traditionally been constructed similarly to footwear for older children and adults. This has resulted in a compromise in performance, for if the bootlet is selected with a sufficiently snug fit to prevent the child from kicking it off, difficulty is experienced in placing the bootlet on the child. Some attempts have been made to divide a bootlet at the instep, however, these attempts have retained at least one continuous side, and have not significantly simplified the application of the bootlets.

Also, footwear for children who are learning to walk often do not provide for cushioning material in the proper location, since children learning to walk most commonly balance on the ball of their foot and it is this area of the sole which needs proper cushioning. The footwear which has been provided with cushioning, provides cushioning over the entire area of the sole and heel.

BRIEF DESCRIPTION OF THE INVENTION

This invention is a footwear for infants and young children, particularly a child's bootlet which comprises a heel portion and a separate arch and toe portion. The heel portion comprises a lower heel, and upper side and rear sides which are dependent thereon. The arch and toe portion comprises a lower sole extending forward of the arch with an upper portion dependent thereon with upright sidewalls and a toe and instep cover. The two portions are removably attached together by a continuous strip fastener, such as a zipper, which extends along the sides and beneath the arch in a substantially straight path. The zipper is covered on the inside of the bootlet with a liner which is permanently attached to one portion and which extends along and beneath the zipper. Preferably the sole and heel also have edges portions which extend over the zipper. The two portions of the bootlet are permanently joined at a single point which is on one side at their upper edges with a welting which is continuous about the upper edges of the rear, one side, and front thereof with unjoined ends which meet at said continuous strip fastener. Since the two portions are joined at a single point, only, application of the bootlet is greatly facilitated as the heel portion is completely free to be easily swung over the child's heel and secured with the zipper. Also, an inner sole is provided which is substantially continuous from the heel to the toe of said bootlet with cushioning material in the heel and beneath the arch. Cushioning material is placed on the outside of the shoe, in the forward portion of said sole plate, beneath the ball of the foot, and is covered with a sole plate.

BRIEF DESCRIPTION OF THE DRAWINGS

The invention will be described with reference to the drawings of which.

DESCRIPTION OF PREFERRED EMBODIMENTS

Figure 1:
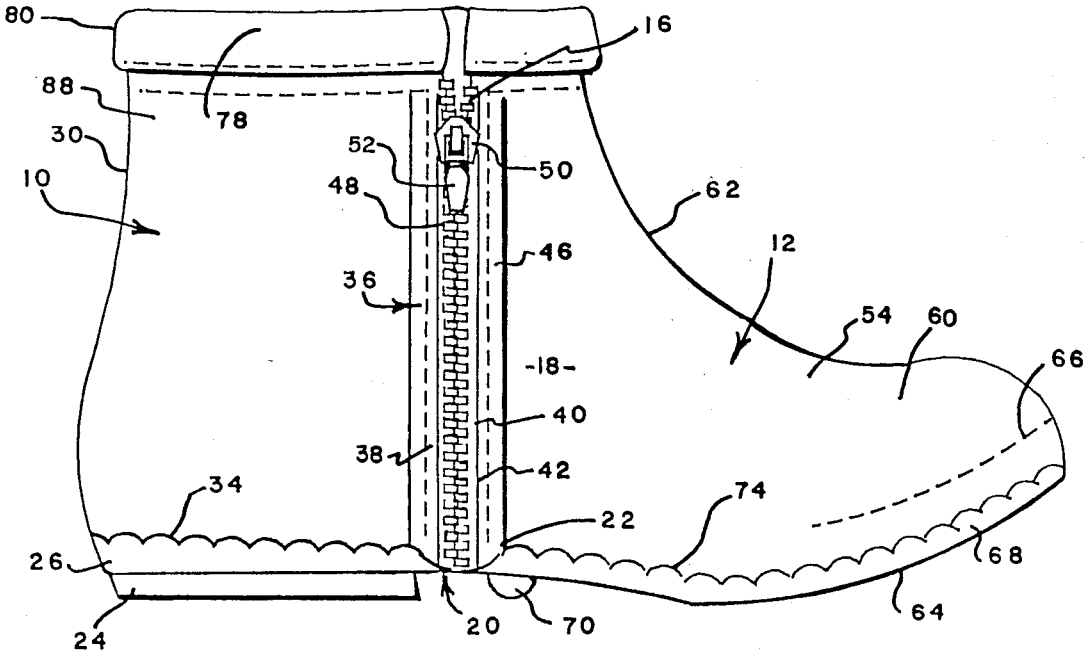
FIG. 1 is a side view of the bootlet of the invention.
Figure 2:
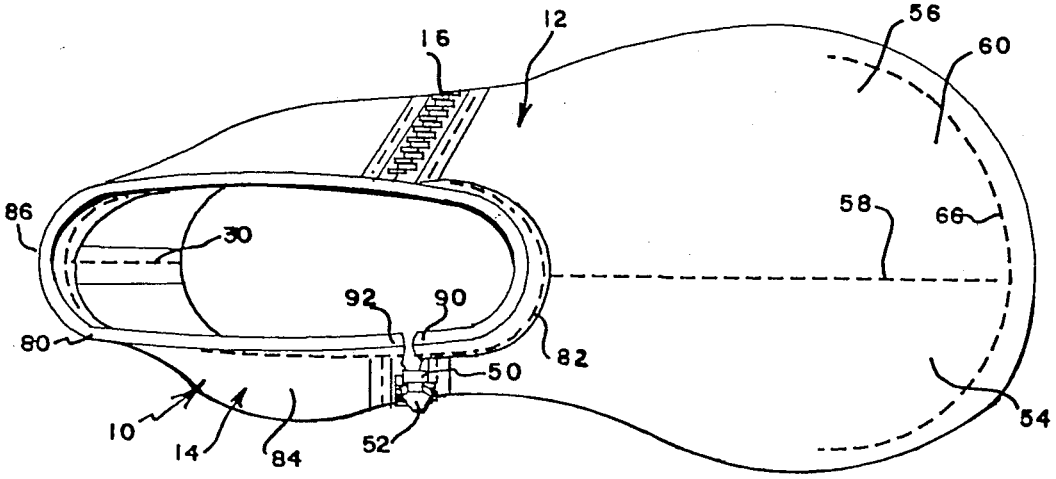
FIG. 2 is a top view of the bootlet of the invention.

Referring to FIGS. 1 and 2, the bootlet 10 is shown with a front portion 12 and a rear portion 14 which meet along a continuous joint 16 which extends in a stra1ght 1ine, vertically along each side such as 18 and across the sole 20, beneath the arch 22. The rear portion 14 is formed of a lower heel 24 attached to a heel plate 26 and upper sides such as 28 which are joined along a continuous seam 30. The lower edges of the upper sides of the heel portion are folded between an inner heel 32 (shown in FIG. 3), and the outer heel plate 26 and are permanently attached thereto by a stitched seam, or by a permanent adhesive. The edge 34 of heel plate 26 is preferably scalloped, as shown. The heel 24 is permanently attached to the heel plate 26 by suitable means, preferably by a permanent adhesive.

A continuous strip fastener, preferably a zipper 36 is provided along the continuous joint 16. The zipper 36 is conventional with parallel strips 38 and 40 of tape 42 which are permanently secured to their respective portions by suitable means, preferably by a continuous sewn seam such as 46. Each strip of tape supports a row of metal teeth 48 which are drawn into engagement by the slider 50 having a tab 52.

The front portion 12 of the bootlet 10 is formed of upper sides 54 and 56 which are joined in a continuous seam 58 along the center line of the bootlet, forming a toe portion 60 and an instep cover portion 62. The upper sides 54 extend beneath the front portion 12 and are joined in a center seam (not shown) along the bottom 64 of the bootlet and are curved around the forward end of the toe portion 60 and joined in a seam 66 which extends between the opposite sides, across the front of the bootlet, thereby completely enclosing the front portion 12. An outer sole 68 is permanently attached to the underside of the bottom 64 of the bootlet by suitable means, preferably by a permanent adhesive and one or more metal fasteners such as rivets 70. The edge 74 of outer sole 68 is also preferably scalloped.

The rear portion 14 is permanently attached to the front portion 12 at a single point 76 which is to one side at the top edge 78. This is preferably achieved with a continuous welting 80 that extends about the front 82, one side 84, and rear 86 of the anklet portion 88 of the bootlet. The ends 90 and 92 of the welting meet at the end of the zipper 36 so that when the zipper slider is moved to its open position shown in FIG. 2, the rear and front portions can be separated as shown in FIG. 3.

Figure 3:
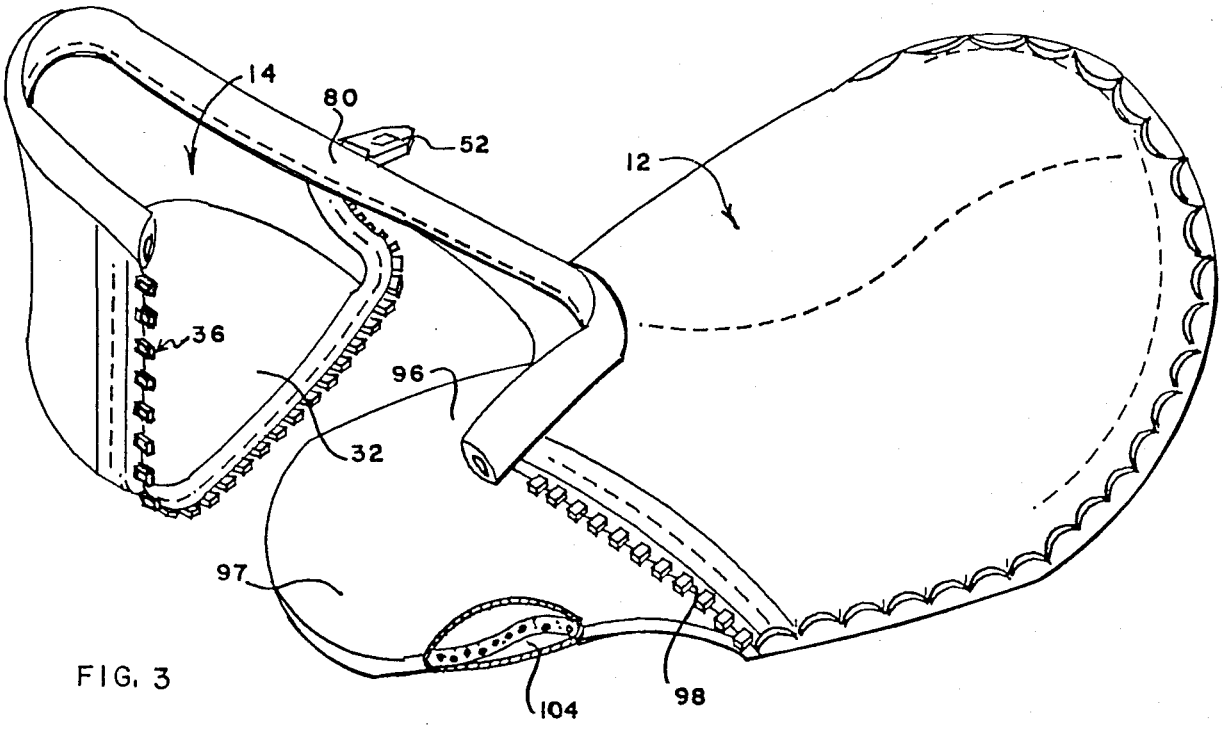
FIG. 3 is a top view of the bootlet of the invention shown with its rear and front portions separated.

Referring now to FIG. 3, the bootlet is shown in its opened configuration, ready for placement on the child's foot. In this configuration, the rear portion 14 has been swung away from the front portion 12 and the two portions are secured together only by the permanent point attachment of welting 80. Preferably, the bootlet includes a inner sole 96 which is continuous from the heel 98 to the toe. A lining 98 is also permanently attached to the front portion 12 and this lining extends along each inside edge of the front portion, projecting rearwardly slightly so as to underlie the zipper 36. The lining 98 has a bottom tongue 104 which extends beneath the heel portion 97 of the inner sole 96 and which is permanently secured thereto in a peripheral seam preferably by a permanent adhesive. A cushioning pad 106 which is formed of material such as compressible plastic foam is provided between the bottom tongue 104 and the heel portion 97 of the inner sole 96, and this pad is permanently bonded between bottom tongue 104 and inner sole 96.

Figure 4:
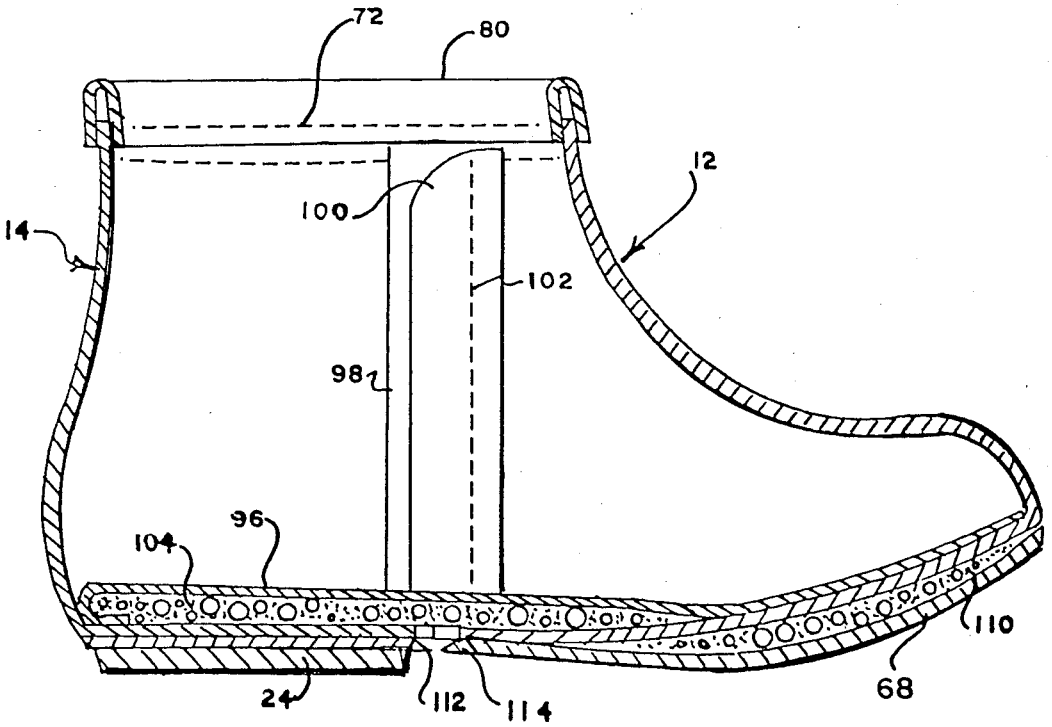
FIG. 4 is a sectional elevational view of the bootlet.

Referring now to FIG. 4, the construction of the bootlet is shown in an elevational sectional view. The continuous welding 80 is folded over the upper edges of the front portion 12 and rear portion 14 and secured thereto with a permanent seam 72. The lining 98 has a tapered upper end 100 and is permanently secured to the front portion 12 with a sewn seam 102. A forward cushioning pad 110 is also provided. The pad 110 is also formed of material such as compressible plastic foam and is secured between the outer sole 68 and the undersurfaces of the joined upper sides 54 and 56, thus locating a cushioning pad directly beneath the ball of the child's foot, insuring a cushioning support beneath the portion of the child's foot which is commonly used when the child learns to walk.

The outer sole 68 preferably has an edge 112 which projects beneath the zipper 36, and the heel plate 26 also preferably has a forward edge 114 which projects beneath the zipper 36 so that these two edges meet and completely cover the zipper.

Figure 5:
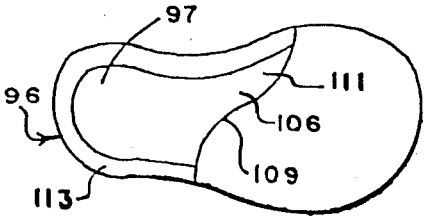
FIG. 5 is a view of the underside of an intersole of the bootlet.

The shape and construction of the cushioning pad 106 is illustrated in FIG. 5, which is a view of the underside of inner sole 96, on a diminished scale. The cushioning pad 106 extends entirely under the heel portion 97 of the inner sole 96 and projects forwardly with an asymetric forward edge 109, to prov1de a forward extension 111 along the medial side of the inner sole 96, thereby providing a cushioning support for the instep of the wearer. The cushioning pad 106 is secured to the undersurface of inner sole 96 by suitable permanent means, e.g., by a permanent adhesive, and preferably, the edge of the inner sole 96 is folded over the outer edge of the cushioning pad 106 and bonded thereto by a continuous, peripheral seam 113 secured with a permanent adhesive.

In use, the bootlet is opened to the configuration as shown in FIG. 3, and placed over the child's toes. The rear portion 14 can then be slipped about the heel and ankle of the child, and the zipper slider 50 can be moved to close the zipper, securing the bootlet snuggly about the child's foot. Since the zipper is moved from side to side, the bootlet can be readily applied while the child is lying on its back since there is no need for access to the rear of the heel to attach the two portions of the bootlet. The application of the bootlet is greatly facilitated by the single, point attachment of the front portion 12 and rear portion 14, since there is complete freedom of movement of the rear portion 14.

Since the bootlet is simple to put on a child's foot, very young children can easily learn to apply the bootlets themselves. No strength is required since the bootlet isn't pulled on over the instep, as required for conventional bootlets. Also, the bootlet doesn't have laces or shoe strings which are difficult for children to fasten. Instead, the child can quickly learn to place the front portion 12 of the bootlet over its toes and to pull the zipper slider 50 along the joint 16, joining the two portions.

The location of the cushioning pad 110 between the outer sole 68 and the undersurface of the toe portion provides very effective cushioning beneath the ball of the foot. The soft resiliency of the cushioning pad 110 is stabilized by the more resilient layers of the inner sole 98 and the joined undersurfaces of upper sides 54 and 56. This provides a stable and protective cushioning effect which is similar to the sensation of walking across a carpet, even on hard surfaces such as wooden floors and concrete. This is very beneficial to children learning to walk, as they invariably lean forward when learning to walk and carry their weight on the balls of their feet.

The invention has been described with reference to the illustrated and presently preferred embodiment. It is not intended that this disclosure of the presently preferred embodiment be unduly restricting. Instead, it is intended that the invention be defined by the means, and their obvious equivalents, set forth in the following claims:

What is claimed is:

1. a child's bootlet which comprises:

(a) a separate heel portion having:

(i) a lower heel plate, and (11) upper side and rear sides dependent thereon;

(b) a separate arch and toe portion having:

(i) a lower sole extending forward of the arch and a coextensive outer sole permanently attached to undersurface thereof, (ii) an upper portion dependent thereon comprising upright sidewalls and a toe and instep cover; and (c) a welting which is continuous about the upper edges of the rear, one side, and front thereof with unjoined ends which meet at said continuous strip fastener, whereby said welting serves as a permanent, single point attachment between said separate heel portion and said separate arch and toe portion, with said heel portion and said arch and toe portion being removably attached together by a continuous strip fastener extending along the sides and beneath the arch in a substantially straight path, about the instep.

2. The bootlet of claim 1, wherein said continuous strip fastener is a zipper.

3. The bootlet of claim 1 including an inner sole which is substantially continuous from the heel to the toe of said bootlet.

4. The bootlet of claim 3 including cushioning material in the heel portion of said inner sole.

5. The bootlet of claim 3 including cushioning material in the forward portion of said sole, beneath the ball of the foot, and located between said lower sole and said lower sole.

6. The bootlet of claim 1 including a liner permanently secured on the inside surface of one of said heel portion and toe and arch portion and extending beneath said continuous strip fastener.

7. The bootlet of claim 3 wherein said heel plate has a forward edge which extends forwardly, beneath its respective row of zipper teeth.

8. The bootlet of claim 2 wherein said outer sole has a rear edge which extends rearwardly, beneath its respective row of zipper teeth.

9. The bootlet of claim 1 including a heel permanently attached to the undersurface of said heel plate and extending forwardly to said continuous strip fastener.

10. The bootlet of claim 9 including at least one metal fastener extending through and permanently securing said outer sole to lower sole and located immediately forward of said continuous strip fastener.

* * * * *